US006923221B2

(12) United States Patent
Riffle

(10) Patent No.: US 6,923,221 B2
(45) Date of Patent: Aug. 2, 2005

(54) VAPOR RECOVERY SYSTEM WITH ORVR COMPENSATION

(75) Inventor: Eric Riffle, Oak Ridge, NC (US)

(73) Assignee: Gilbarco Inc., Greensboro, NC (US)

( * ) Notice: Subject to any disclaimer, the term of this patent is extended or adjusted under 35 U.S.C. 154(b) by 0 days.

(21) Appl. No.: 10/727,689

(22) Filed: Dec. 4, 2003

(65) Prior Publication Data

US 2005/0121100 A1 Jun. 9, 2005

(51) Int. Cl.[7] ..... B65B 31/00

(52) U.S. Cl. ..... 141/59; 141/65; 141/83; 141/95; 141/197; 141/290; 141/309

(58) Field of Search ..... 141/4, 8, 44, 45, 141/47, 59, 65, 83, 94, 95, 192, 197, 285, 290, 301, 302, 309

(56) References Cited

U.S. PATENT DOCUMENTS

| | | | | | |
|---|---|---|---|---|---|
| 3,581,782 | A | * | 6/1971 | Onufer | 141/59 |
| 3,899,009 | A | * | 8/1975 | Taylor | 141/59 |
| 4,649,970 | A | | 3/1987 | Bower et al. | 141/302 |
| 4,825,914 | A | | 5/1989 | Leininger | 141/59 |
| 5,040,577 | A | | 8/1991 | Pope | 141/59 |
| 5,174,346 | A | | 12/1992 | Healy | 141/226 |
| 5,178,197 | A | | 1/1993 | Healy | 141/217 |
| 5,207,249 | A | | 5/1993 | Healy | 141/59 |
| 5,215,655 | A | | 6/1993 | Mittermaier | 210/234 |
| 5,229,746 | A | | 7/1993 | Healy et al. | 340/459 |
| 5,297,574 | A | | 3/1994 | Healy | 137/68.1 |
| 5,305,807 | A | | 4/1994 | Healy | 141/59 |
| 5,327,944 | A | | 7/1994 | Healy | 141/59 |
| 5,333,654 | A | | 8/1994 | Faeth | 141/1 |
| 5,386,859 | A | | 2/1995 | Healy | 141/59 |
| 5,507,325 | A | | 4/1996 | Finlayson | 141/83 |
| 5,609,192 | A | * | 3/1997 | Anderson et al. | 141/208 |
| 5,676,181 | A | | 10/1997 | Healy | 141/59 |
| 5,765,603 | A | | 6/1998 | Healy | 141/59 |
| 5,782,275 | A | | 7/1998 | Hartsell, Jr. et al. | 141/94 |
| 5,813,443 | A | | 9/1998 | Dalhart et al. | 141/206 |
| 5,992,395 | A | | 11/1999 | Hartsell, Jr. et al. | 123/516 |
| 6,047,745 | A | | 4/2000 | Fournier | 141/59 |
| 6,095,204 | A | | 8/2000 | Healy | 141/59 |
| 6,131,768 | A | | 10/2000 | Taivalkoski et al. | 222/14 |
| 6,151,955 | A | | 11/2000 | Ostrowski et al. | 73/40 |
| 6,176,275 | B1 | | 1/2001 | Hill | 141/65 |
| 6,236,295 | B1 | | 5/2001 | Healy | 335/205 |
| 6,247,508 | B1 | | 6/2001 | Negley, III et al. | 141/94 |
| 6,275,686 | B1 | | 8/2001 | Hotine | 455/253.2 |
| 6,308,727 | B1 | | 10/2001 | Healy | 137/68.15 |
| 6,332,483 | B1 | | 12/2001 | Healy | 141/59 |
| 6,334,470 | B2 | | 1/2002 | Healy | 141/59 |
| 6,360,785 | B1 | | 3/2002 | Healy | 141/59 |
| 6,360,789 | B2 | | 3/2002 | Walker et al. | 141/95 |
| 6,418,981 | B1 | | 7/2002 | Nitecki et al. | 141/4 |
| 6,478,849 | B1 | | 11/2002 | Taylor et al. | 95/11 |

FOREIGN PATENT DOCUMENTS

DE 19821559 11/1999

OTHER PUBLICATIONS

"Estimated Hydrocarbon Emmissions of Phase II and Onboard Vapor Recovery Systrems," dated Apr. 12, 1994, amended May 12, 1994, State of California Environmental Protection Agency Air Resources Board.

* cited by examiner

*Primary Examiner*—Timothy L. Maust
(74) *Attorney, Agent, or Firm*—Withrow & Terranova, PLLC

(57) ABSTRACT

A fuel dispenser with a booted nozzle for vapor recovery is modified to include check valves in a vapor return path. The check valves selectively allow atmospheric air into the vapor return path to alleviate nuisance shut offs at the nozzle when ORVR vehicle is being fueled. The check valves may be included anywhere in the vapor return path between the nozzle and the vapor recovery vacuum assist pump. The fuel dispenser may further include a pressure sensor in the vapor return line so that the fuel dispenser can determine if the vehicle is an ORVR vehicle or not. If the fuel dispenser determines that an ORVR vehicle is present, the fuel dispenser may modify the operation of the vapor recovery system.

50 Claims, 9 Drawing Sheets

VAPOR RECOVERY SYSTEM WITH ORVR COMPENSATION

FIELD OF THE INVENTION

The present invention relates to a vapor recovery system in a fuel dispensing environment that compensates for the presence of an onboard refueling vapor recovery (ORVR) vehicle.

BACKGROUND OF THE INVENTION

Automobiles are an indispensable part of everyday life to many people. Coupled with the existence of automobiles is a requirement for an energy source to provide the motive force to the wheels of the automobiles. The vast majority of the vehicles currently on the road require gasoline or diesel fuel as this energy source. As a result, vehicles are equipped with fuel tanks that must be filled periodically as the fuel is depleted. During a conventional or standard fueling operation, incoming fuel displaces fuel vapor from the head space of the fuel tank. The displaced fuel vapor exits through the filler pipe of the vehicle into the atmosphere.

The Environmental Protection Agency and various state agencies including the California Air Resources Board (CARB) have been proposing various regulations to limit the amount of fuel vapor released into the atmosphere during the fueling of a motor vehicle. While this legislation has not directly impacted many fueling environments, some states, such as California, have enacted much more stringent rules and regulations governing the amount of fuel vapor that can be released.

As a result of the rulemaking at the state level, fuel dispenser manufacturers began equipping fuel dispensers with vapor recovery systems that collect fuel vapor vented from the fuel tank filler pipe during the fueling operation and transfer the vapor to a fuel storage tank. The early vapor recovery systems were balance systems that had a boot around the nozzle. The boot formed a seal around the filler neck aperture. In balance systems, as fuel is introduced into the fuel tank, the displaced vapors are trapped by the boot and conveyed to a vapor recovery line in the hose. This arrangement relies on the pressure of the displaced vapors to move the vapors to the fuel storage tank.

A subsequently developed system added a vacuum pump to the vapor recovery line to assist in the recovery of vapor. The vacuum pump actively draws the displaced vapors through holes in the nozzle to a vapor recovery line in the hose. This arrangement may allow the boot to be eliminated, because the vacuum pump catches the vapors before they can escape. Two primary variations exist for the vacuum assist vapor recovery systems. The first variation is a constant speed pump with a proportional valve, and the second variation is a variable speed pump with an on/off valve.

Recently, onboard, or vehicle-carried, fuel vapor recovery and storage systems (commonly referred to as onboard refueling vapor recovery or ORVR) have been developed in which the head space in the vehicle fuel tank is vented through a charcoal-filled canister so that the vapor is absorbed by the charcoal. Subsequently, the fuel vapor is withdrawn from the canister into the engine intake manifold for mixture and combustion with the normal fuel and air mixture.

A problem arises when an ORVR vehicle is fueled at a fuel dispenser having a vacuum assist vapor recovery system. Specifically, the two vapor recovery systems compete against one another for the recovery of the vapors. This competition wastes energy, increases wear and tear on the vacuum pump, and may ingest excessive air into the underground storage tank. Specifically, when a vacuum assist vapor recovery system operates concurrently with an ORVR system, the fueling environment's vapor recovery system will draw air (without fuel vapors) into the vapor return line. This air is conveyed to the underground fuel storage tank. This air then mixes with the fuel in the tank and expands, causing pressure levels within the underground tank to increase. As the pressure level increases, a pressure valve may release some of the vapor within the tank to prevent over-pressurization. This may begin a cycle of tank "breathing."

The problems associated with the competition between the two systems have been recognized and discussed in "Estimated Hydrocarbon Emissions of Phase II and Onboard Vapor Recovery Systems" dated Apr. 12, 1994, amended May 24, 1994, by the California Air Resources Board (CARB). That paper suggests the use of a "smart" interface on a nozzle to detect an ORVR vehicle and close one vapor intake valve on the nozzle when an ORVR vehicle is being fueled. By closing the valve on the nozzle, no air is drawn into the underground tank.

Another solution, introduced by the assignee of the present invention, is to use a pressure sensor within the vapor return line to determine if an ORVR vehicle is present. If an ORVR vehicle is detected, the vapor recovery system is adjusted so that a small amount of air is drawn in through the vapor recovery system in the belief that this small amount of air may expand to approximately the volume of fuel that was dispensed and minimize the risk of "breathing" by the underground storage tank. This approach is memorialized in U.S. Pat. Nos. 5,782,275 and 5,992,395, both of which are hereby incorporated by reference in their entireties.

Another problem has been discovered when ORVR vehicles are fueled at balance-type vapor recovery fuel dispensers where a seal is formed between the nozzle and the vehicle fuel tank. Specifically, the ORVR system of the vehicle may create a negative pressure that draws vapors from the underground storage tank into the fuel tank of the vehicle and may reduce pressure levels in the underground storage tank. Alternatively, in vacuum assist vapor recovery systems, the negative pressure will not draw vapors from the underground storage tank, but will gradually increase the vacuum in the fill pipe of the fuel tank. This increase in the negative pressure may cause a nuisance shut-off where the nozzle valve prematurely closes, stopping the delivery of fuel. To counteract these nuisance shut-offs, some manufacturers have begun introducing apertures in the boot by perforating the boot in one or two locations. These apertures allow atmospheric air into the boot and fuel tank to prevent the development of a negative pressure at the nozzle. However, when the vehicle being fueled is not an ORVR vehicle, the apertures allow vapor-laden air to escape into the atmosphere, defeating the purpose of the vapor recovery systems.

Thus, there is a need for additional solutions that allow the fuel dispenser to sense ORVR vehicles and take corrective measures to prevent over-pressurization of the underground storage tank, eliminate nuisance shutoffs, and allow for efficient vapor recovery to comply with the appropriate state and federal regulations.

SUMMARY OF THE INVENTION

The present invention introduces a check valve into a boot in place of the, always open air flow apertures. The check valve closes in the presence of positive pressure and opens in the presence of a negative pressure. The positive pressure is indicative of a non-ORVR vehicle and the closed valve allows normal vapor recovery by the vapor recovery system of the fueling environment. The negative pressure is indicative of an ORVR vehicle and the open valve allows air to enter the nozzle to prevent a nuisance shut-off.

The check valve of the present invention may be used in a full boot or a smaller boot, called a "mini-boot," that forms a soft seal with the vehicle. The mini-boot is being used with vacuum assist systems, and the present invention is thus capable of being used in both balance systems and vacuum assist systems.

In alternate embodiments, the check valve may be moved from the boot to other locations in the vapor return line. In particular, the check valve can be positioned in the nozzle body or in the vapor hose. In these embodiments, the check valve performs the same function.

The check valve of the present invention may further be used with a pressure sensor in the vapor recovery system. The pressure sensor can be used to infer the presence or absence of an ORVR vehicle and adjust the vapor recovery system as desired. In particular, the check valve and pressure sensor may be used with a constant speed pump associated with a proportional valve. To adjust the vapor recovery system, the aperture of the proportional valve is adjusted. The check valve and pressure sensor may also be used in a system with two constant speed pumps, each having its own proportional valve. To adjust the vapor recovery system, the proportional valves are adjusted. The check valve and pressure sensor may also be used in a system with a variable speed pump. The variable speed pump may have an optional on/off valve associated therewith. To adjust the vapor recovery system, the speed of the pump may be changed.

In one variation of adjusting the vapor recovery system, the vapor recovery system may be throttled back. In a second variation, the vapor recovery system may be turned off. The throttle back may be done by reducing the speed of a variable speed pump or by adjusting a proportional valve associated with a constant speed pump.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

FIG. 11 illustrates a flow chart showing one embodiment of the process of the present invention wherein the vapor recovery system is normally on.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Figure 1:
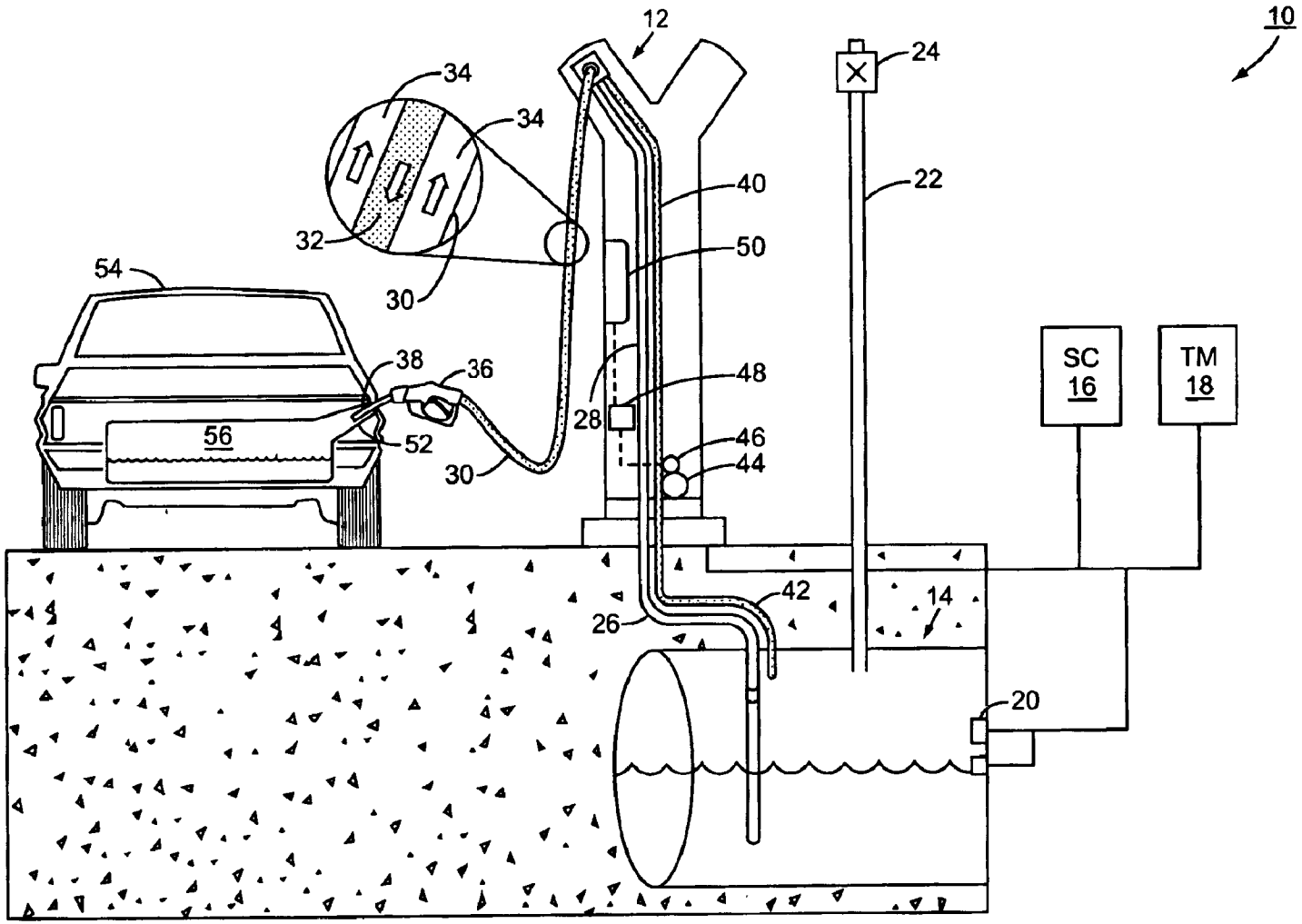
FIG. 1 (PRIOR ART)
FIG. 1 illustrates a partial view of a conventional fueling environment with a fuel dispenser therein.

Referring now to the drawings in general and FIG. 1 in particular, a conventional fueling environment 10 is illustrated. The fueling environment 10 includes a plurality of fuel dispensers 12 (only one shown for conciseness) fluidly coupled to an underground storage tank 14 and electrically connected to a site controller (SC) 16 and/or a tank monitor (TM) 18. The fuel dispenser 12 may be an ENCORE® or ECLIPSE® fuel dispenser sold by assignee of the present invention, Gilbarco Inc., 7300 W. Friendly Ave., Greensboro, N.C. 27410, or other fuel dispenser as is well understood. The site controller 16 may be the G-SITE® or PASSPORT®, sold by assignee of the present invention, and the tank monitor 18 may be the TLS 350™, sold by assignee's affiliated company Veeder-Root, 125 Powder Forest Drive, Simsbury, Conn. 06070. Other comparable devices may be used in different fueling environments 10. It should be appreciated that the site controller 16 and/or the tank monitor 18 may be positioned within a back office or other building (not shown) within the fueling environment 10. These devices 16, 18 may handle various functions within the fueling environment, such as fueling transaction authorization, pump activation, and the like as is well understood.

The underground storage tank 14 may have sensors 20 positioned therein that report pressure readings, volume readings, temperature readings, and the like to the tank monitor 18 as is well understood. Further, the underground storage tank 14 may have a vent pipe 22 with a pressure valve 24 associated therewith. Pressure valve 24 may open when the underground storage tank 14 is over-pressurized, wherein the opening of the pressure valve 24 allows vapors to vent into the atmosphere. Alternatively, if the underground storage tank 14 has too much negative pressure, the pressure valve 24 may open and allow atmospheric air to be drawn into the underground storage tank 14 as is well understood.

The underground storage tank 14 delivers fuel to the fuel dispenser 12 by one or more underground pipes 26 (one shown). A submersible turbine pump (not shown), such as Red Jacket's QUANTUM® pump, may draw fuel from the underground storage tank 14 and pump the fuel to the fuel dispenser 12. Alternatively, the fuel dispenser 12 may include a pump (not shown) that draws the fuel from the underground storage tank 14 through the pipe 26 to the fuel dispenser 12. Once inside the fuel dispenser 12, the fuel is carried by internal pipes 28 to a hose 30. The hose 30 includes a fuel carrying passage 32 within a separate vapor recovery annular passage 34 that is adapted to convey vapors. The hose 30 terminates in a nozzle 36 with a spout 38.

The vapor recovery annular passage 34 is fluidly connected to internal vapor return line 40 within the fuel dispenser. Internal vapor return line 40 may be fluidly connected to underground vapor return line 42 which conveys captured vapors back to the underground storage tank 14. In some vapor recovery systems, a vapor recovery pump 44 may be associated with vapor return lines 40, 42. The vapor recovery pump 44, if present, may be controlled by a vapor recovery pump controller 46, which communicates with the fuel dispenser controller 48. Fuel dispenser controller 48 controls various functions of the fuel dispenser 12 including the vapor recovery pump 44 and the customer interface 50. The customer interface 50 may include keypads, a display, fuel selection buttons, a card reader, and the like as is well understood.

More information on conventional vapor recovery systems can be found in U.S. Pat. No. 5,040,577, which is hereby incorporated by reference in its entirety. Likewise, it should be appreciated that conventional vapor recovery systems exist that have a single constant speed pump with a pair of proportional valves to control each side of the fuel dispenser; a pair of constant speed pumps, each with a proportional valve that operates independently to control each side of the fuel dispenser; or a pair of variable speed pumps that operate independently to control each side of the fuel dispenser.

During a fueling operation, a customer (not shown) may interact with the fuel dispenser 12 through the customer interface 50. After fuel selection, the customer inserts the spout 38 of the nozzle 36 into filler neck 52 of vehicle 54. As fuel is dispensed through the spout 38, vapors within the fuel tank 56 are displaced and captured by the vapor recovery system to be returned to the underground storage tank 14.

Figure 2:
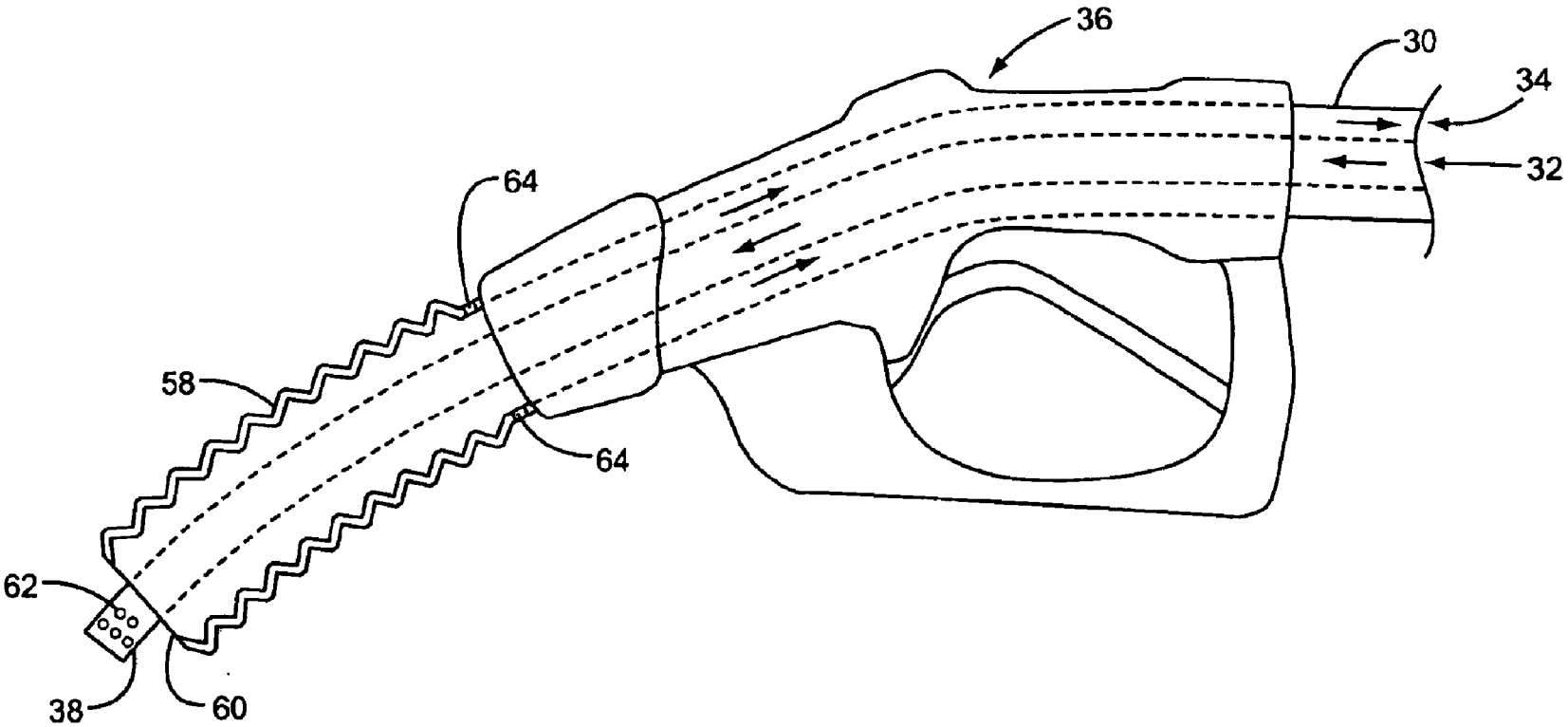
FIG. 2 (PRIOR ART)
FIG. 2 illustrates a conventional booted nozzle with air flow holes therein.

FIG. 2 illustrates a conventional vapor recovery capable nozzle 36 isolated from the fuel dispenser 12. The nozzle 36 has a boot 58 secured thereto. The boot 58 may be made from a plastic material and compress when the spout 38 is inserted into the filler neck 52 (FIG. 1). The terminal end 60 of the boot 58 makes a fluid seal with the vehicle 54. Vapors from the fuel tank 56 are caught by the boot 58 as they exit the filler neck 52 and are passed to the vapor return portion of the hose, such as the vapor recovery annular passage 34. It should be appreciated that the valves within the nozzle 36 that open and close the fuel flow have been omitted, but operate conventionally. In some conventional embodiments, the spout 38 has apertures 62 therein to capture the vapors. While booted nozzles such as conventional nozzle 36 are normally used in balance-type vapor recovery systems, some vacuum assist vapor recovery systems also use booted nozzles such as conventional nozzle 36.

When a nozzle 36 with a boot 58 is used to fill an ORVR vehicle 54, a negative pressure is created which can result in nuisance shut-offs or, in extreme cases, drawing vapor from the underground storage tank 14. Neither is desirable. Specifically, the negative pressure in an ORVR vehicle 54 is created by the filler neck 52 narrowing from a larger diameter to a smaller diameter and the fact that the vent line of the charcoal canister does not terminate in the filler neck 52. The filler neck 52 thus creates a venturi effect which is well documented enough to be dubbed by the Society of Automotive Engineers (SAE) an "ejector effect" to draw air into the filler neck 52. To address this problem, some manufacturers have begun introducing apertures 64 within the boot 58. Typically, one or two apertures 64 are created. Currently, such apertures 64 are likely to be found on vacuum assist systems rather than balance systems, but it is conceivable that balance system nozzles could have the apertures 64 as well. Apertures 64 allow atmospheric gases to pass through the apertures 64 into the boot 58 when there is a negative pressure in the boot 58. Unfortunately, when there is not an ORVR vehicle 54 being fueled, these apertures 64 allow vapors caught within the boot 58 to pass into the atmosphere.

While the boot 58 in FIG. 2 is illustrated as a full-size boot, meaning that the boot covers substantially all of the spout 38, there are conventional nozzles that have a mini-boot. Mini-boots are well understood in the industry to cover only a portion of the spout 38. Full-size boots typically make a hard seal against the filler neck 52 while mini-boots make a soft seal thereagainst.

Figure 3:
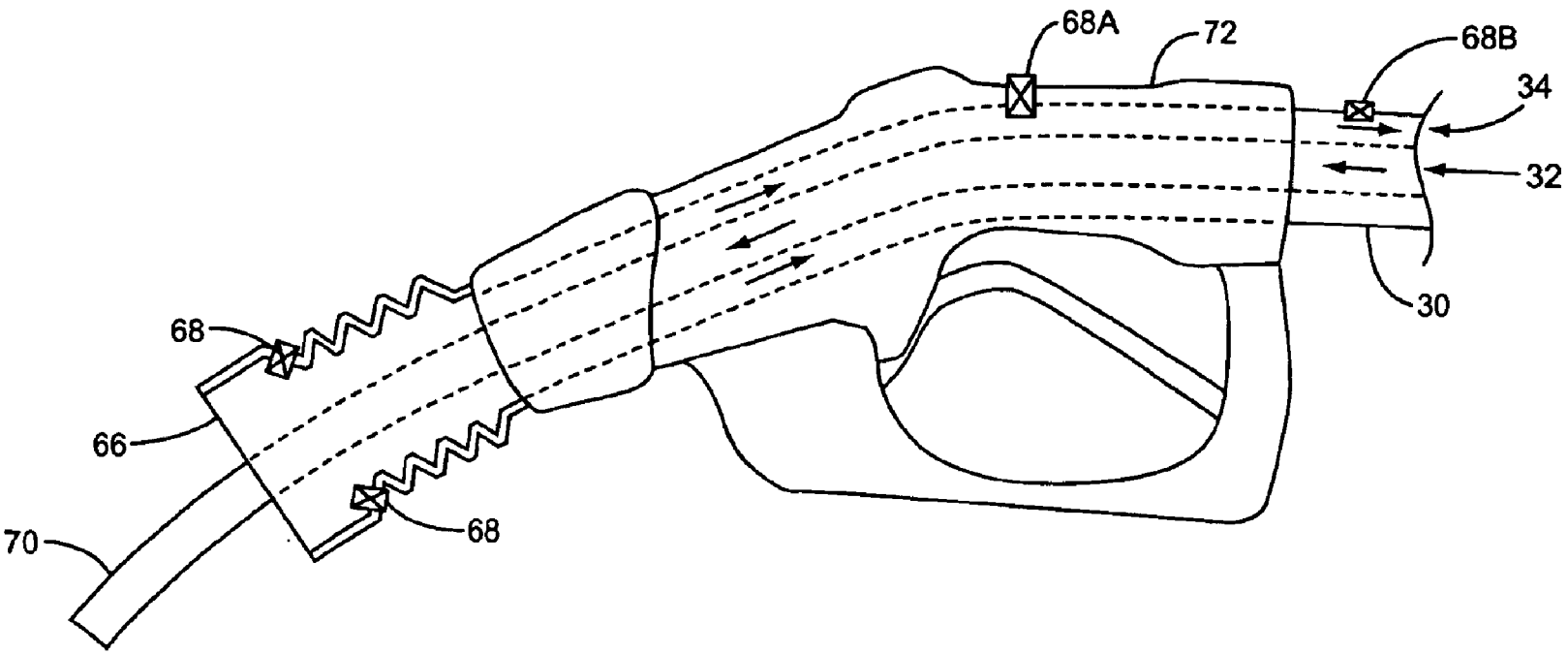
FIG. 3 illustrates a nozzle according to one embodiment of the present invention.

To address this problem, the present invention incorporates the use of one or more check valves and eliminates the apertures 64. As illustrated in FIG. 3, a boot 66 has the same accordion-like structure as boot 58 (FIG. 1), but check valves 68 provide selective fluid communication between the atmosphere and the interior of the boot 66. While the boot 66 is illustrated as a mini-boot, it should be appreciated that the invention is equally applicable to a full-sized boot. Empirical data indicates that a full-sized boot forms a hard seal with the vehicle filler neck 52 and a mini-boot forms a soft seal with the vehicle filler neck 52. While the check valves 68 are shown positioned on opposite sides of the spout 70, it should be appreciated that the check valves 68 may be in any circumferential orientation desired. Likewise, it is within the scope of the present invention to have only a single check valve 68 or to have more than two check valves 68. Still further, the check valves 68 may be repositioned on the boot 66 or off the boot 66.

Specifically contemplated locations for the check valves 68 include the boot 66, the nozzle body 72 (shown as check valve 68A), the hose 30 (shown as check valve 68B), and internal vapor return line 40 (not shown). Note that while hose 30 shows the vapor return portion of the hose being an outer annular passage 34, it should be appreciated that in a conventional vacuum assist hose (not shown), the vapor return portion of the hose is the interior passage, and thus the check valves 68 could extend through the outer annular passage that carries fuel and to the interior vapor return portion of the hose. Essentially, any position upstream (vapor-wise) of the vapor recovery pump 44 (not shown) that is in fluid connection with the path of the recovered vapor is potentially suitable for the present invention. The defining criterion for the check valves 68 is that they allow atmospheric gases to enter the vapor path and/or return line and offset the negative pressure at the spout 70 so as to prevent the nuisance shut-off. While the positions closer to the vapor recovery pump 44 are potentially less desirable in that it may be hard to offset the negative pressure quickly enough to stop the nuisance shut-off, such positions are still within the scope of the present invention.

Furthermore, it has been discovered in testing of the present invention that the pressure proximate the check valve 68 will be a function of whether the vacuum pump is on or off, the use of a full boot or a mini-boot, and the location of the check valve 68. Depending on the above factors, the testing indicates that it is possible to have a negative pressure even when a standard vehicle is being fueled. However, for an identical system, an ORVR vehicle 54 will always have a lower pressure than the standard vehicle. The following discussion will use the term "negative pressure" with the understanding that the negative pressure is relative to a comparably equipped standard vehicle situation. While it is possible to have check valves 68, 68A, and 68B in one device, it is expected that only one or two check valves be used at a time.

In the preferred implementation, the check valves 68 will be normally closed and will open in the presence of a negative pressure within the boot 66. Thus, when a non-ORVR vehicle 54 is being fueled, the check valves 68 will remain closed and vapor will pass into the vapor recovery system as normal. However, when an ORVR vehicle 54 is being fueled, a negative pressure (or as noted above, a pressure lower than developed with a standard vehicle) will develop within the boot 66 and the check valves 68 will open, allowing air to pass into the boot 66 and stop the nuisance shut-off.

Figure 4:
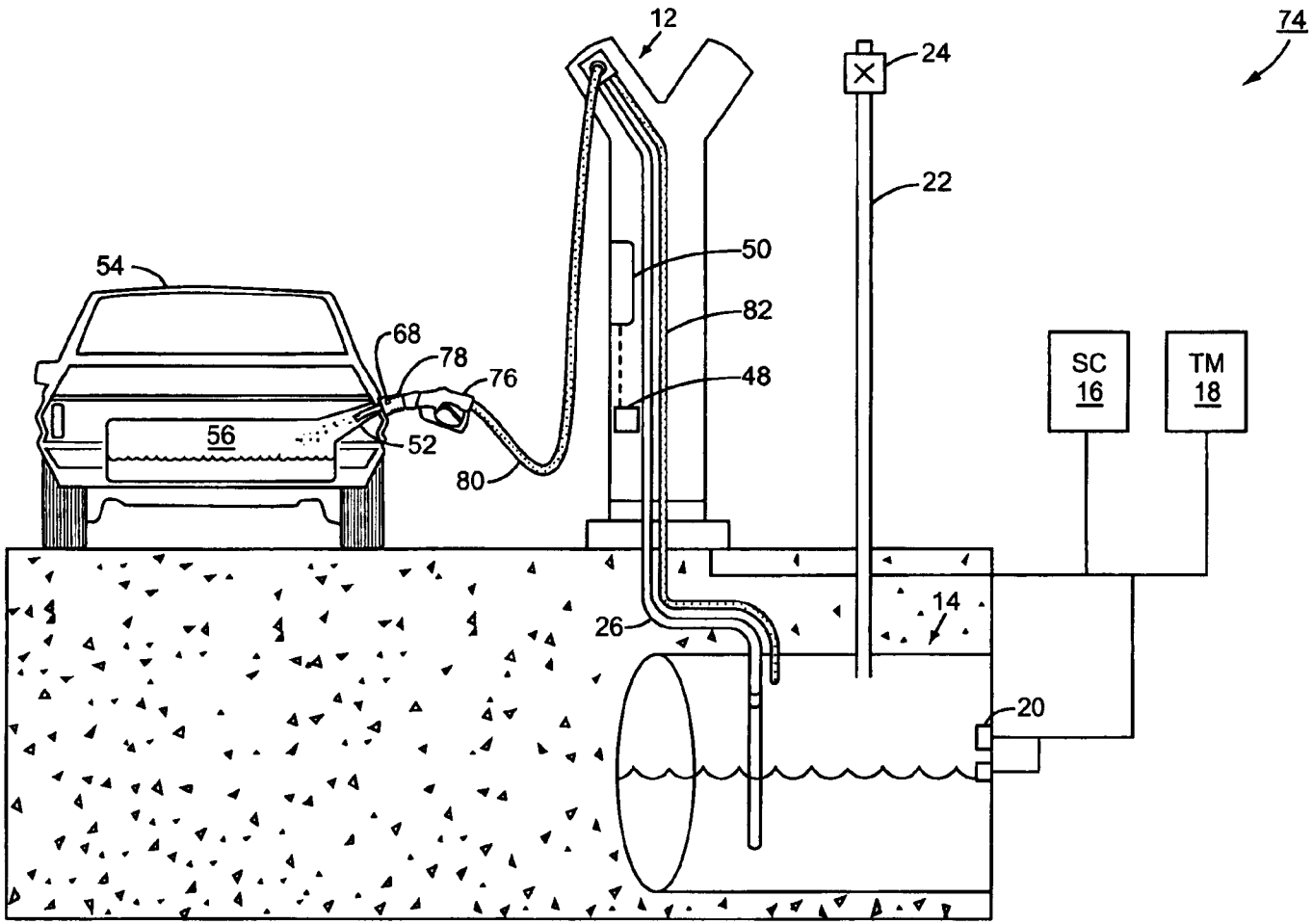
FIG. 4 illustrates a balance vapor recovery system for use with the nozzle of FIG. 3.

The use of the check valve 68 of the present invention is suitable for use in many different vapor recovery systems as illustrated in FIGS. 4–10. For example, as illustrated in FIG. 4, the check valves 68 can be used in a balance vapor recovery system 74. A nozzle 76 with a boot 78 is inserted into the filler neck 52 of the vehicle 54. Vapors expelled from the fuel tank 56 are caught by the boot 78 and returned to the underground storage tank 14. The vapors travel from the boot 78 through the vapor return portion of hose 80 and then in internal vapor return line 82. In the event an ORVR vehicle 54 is being fueled, the check valves 68 open in the presence of the lower pressure and allow air into the vapor return line 82 so that vapors are not drawn from the underground storage tank 14 to the fuel tank 56. Likewise, any negative pressure that might cause a nuisance shut-off is offset by the air that enters through the check valves 68. While the check valves 68 are shown in the boot 78, as noted above, they can be repositioned as needed or desired.

Figure 5:
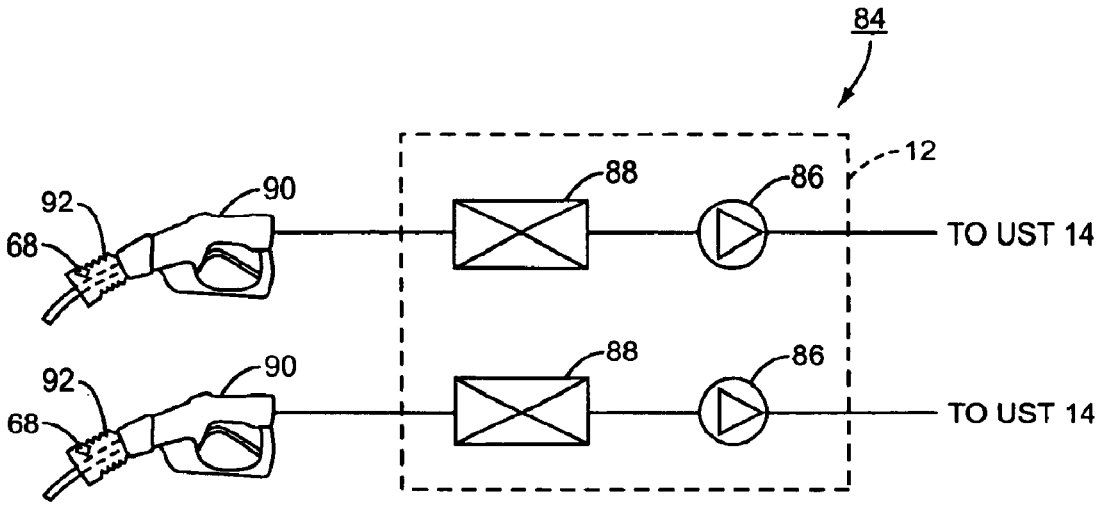
FIG. 5 illustrates schematically a vacuum assist, paired variable speed pump vapor recovery system for use with the nozzle of FIG. 3.

The present invention is also well-suited for use in the various vacuum assist vapor return systems. FIG. 5 illustrates a first vacuum assist vapor return system 84. The vapor return system 84 includes two variable speed pumps 86 and two optional on/off valves 88. In this system, each side of the fuel dispenser 12 has its own vapor recovery system consisting of a variable speed pump 86 and the respective optional on/off valve 88. Each nozzle 90 is equipped with a boot or mini-boot 92. The check valve 68 is shown in association with the boot 92, but can be repositioned as noted. The variable speed pumps 86 are controlled to draw vapors in at a rate in relation to the rate at which fuel is dispensed. On/off valves 88 control whether or not the vacuum drawn by the variable speed pumps 86 reaches the nozzle end of the vapor return path. Note that in some embodiments, the on/off valves 88 may be located in the nozzle 90. If the on/off valves 88 are present, when a corresponding side of the fuel dispenser 12 has a fueling transaction, the respective on/off valve 88 is opened when fueling occurs and is closed when the fueling transaction is completed to prevent air from going to the UST 14 when fueling is not being performed. An alternate way to prevent this air/vapor flow is to turn off the variable speed pumps when no fuel transaction is occurring.

In this embodiment, when a non-ORVR vehicle 54 is fueled, the check valves 68 remain closed, and vapors caught by the boot 92 are drawn to the underground storage tank (UST) 14 by the appropriate variable speed pump 86. It should be appreciated that while on/off valves 88 are noted as being two-state valves, any sort of valve that is capable of shutting off completely the flow path may be used. Thus, for example, a proportional valve could be used in place of a two-state valve if needed or desired.

When an ORVR vehicle 54 is fueled, a lower negative pressure is created at the nozzle 90 by the ORVR system. The check valve 68 opens, allowing air to flow into the vapor return path. This air offsets the negative pressure and is drawn to the UST 14 and the ORVR system as needed to prevent a nuisance shut-off.

Figure 6:
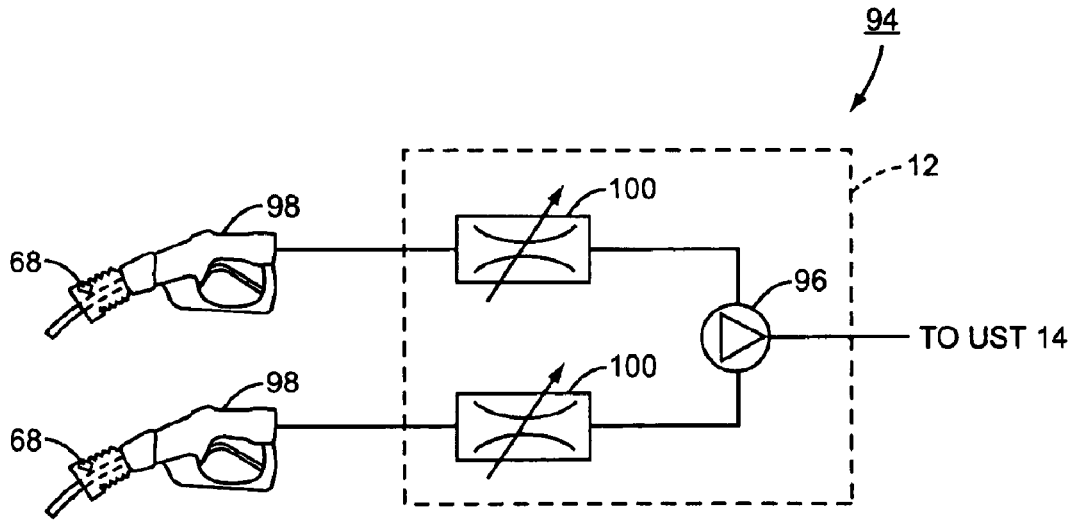
FIG. 6 illustrates schematically a vacuum assist, single constant speed pump vapor recovery system for use with the nozzle of FIG. 3.

A second vacuum assist system is illustrated in FIG. 6, wherein a constant speed pump system 94 is illustrated. A single constant speed pump 96 is connected to the nozzles 98 via respective proportional valves 100. The rate of vapor recovery remains proportionate to the rate at which fuel is dispensed, but instead of controlling the speed of the pump 96, the respective aperture sizes of the proportional valves 100 are controlled. In this manner, a single pump may be used for both sides of the fuel dispenser 12 since the rate of vapor recovery is controlled by independent valves 100 rather than by the speed of the pump 96. As noted above, the check valves 68 need not be positioned on the boots, but can be repositioned within the vapor return system upstream of the proportional valves 100. While it is possible to position the check valves 68 between the proportional valves 100 and the constant speed pump 96, such is not preferred because if the proportional valve 100 is closed, then the check valves 68 may not perform their intended function of letting air reach the nozzle 98 to prevent the nuisance shut-off.

When a non-ORVR vehicle 54 is fueling, the check valves 68 remain closed and vapor is drawn to the UST 14 through the proportional valves 100 by the constant speed pump 96. However, when an ORVR vehicle 54 is fueling, a lower negative pressure is created at the nozzle 98, which forces the appropriate check valve 68 to open. When the check valve 68 opens, air flows into the vapor return line offsetting the lower negative pressure at the nozzle. This air is available to be drawn into the UST 14 or the ORVR system as needed.

Figure 7:
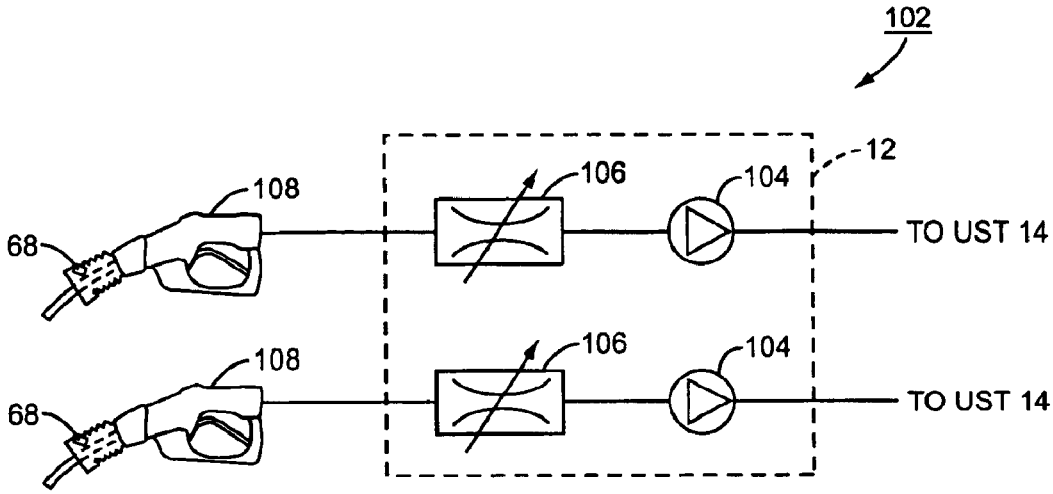
FIG. 7 illustrates schematically a vacuum assist vapor recovery system with two independent constant speed pumps for use with the nozzle of FIG. 3.

A third vacuum assist system is illustrated in FIG. 7. The system of FIG. 7 is a second constant speed pump system 102; however, each side of the fuel dispenser 12 has its own constant speed pump 104. Each constant speed pump 104 has a respective proportional valve 106. The rate of vapor recovery remains proportionate to the rate at which fuel is dispensed, but instead of controlling the speed of the pump, the degree to which the respective proportional valve 106 is opened is controlled. In this manner, two smaller capacity pumps may be used in place of the single constant speed pump 96. As noted above, the check valves 68 need not be positioned on the boots, but can be repositioned within the vapor return system upstream of the proportional valves 106. While it is possible to position the check valves 68 between the proportional valves 106 and the constant speed pump 104, such is not preferred because if the proportional valve 106 is closed, then the check valves 68 may not perform their intended function of letting air reach the nozzle 108 to prevent the nuisance shut-off.

When a non-ORVR vehicle 54 is fueling, the check valves 68 remain closed and vapor is drawn to the UST 14 through the proportional valves 106 by the appropriate constant speed pump 104. However, when an ORVR vehicle 54 is fueling, a lower negative pressure is created at the nozzle 108, which forces the appropriate check valve 68 to open. When the check valve 68 opens, air flows into the vapor return line offsetting the negative pressure at the nozzle. This air is available to be drawn into the UST 14 or the ORVR system as needed.

An additional improvement on the present invention includes using a pressure sensor in the vapor return line of a vacuum assist vapor recovery system. The pressure sensor can be used to determine if there is an ORVR vehicle being fueled. If it is determined that there is an ORVR vehicle, the operation of the vacuum assist vapor recovery system can be adjusted so that an appropriate amount of air is drawn into the underground storage tank 14 without over-pressurizing the underground storage tank 14 or leaving the underground storage tank 14 under-pressurized. While the use of a pressure sensor to determine the presence or absence of an ORVR vehicle is described adequately in the previously incorporated U.S. Pat. Nos. 5,782,275 and 5,992,395, some of that discussion will be set forth again herein.

Figure 8:
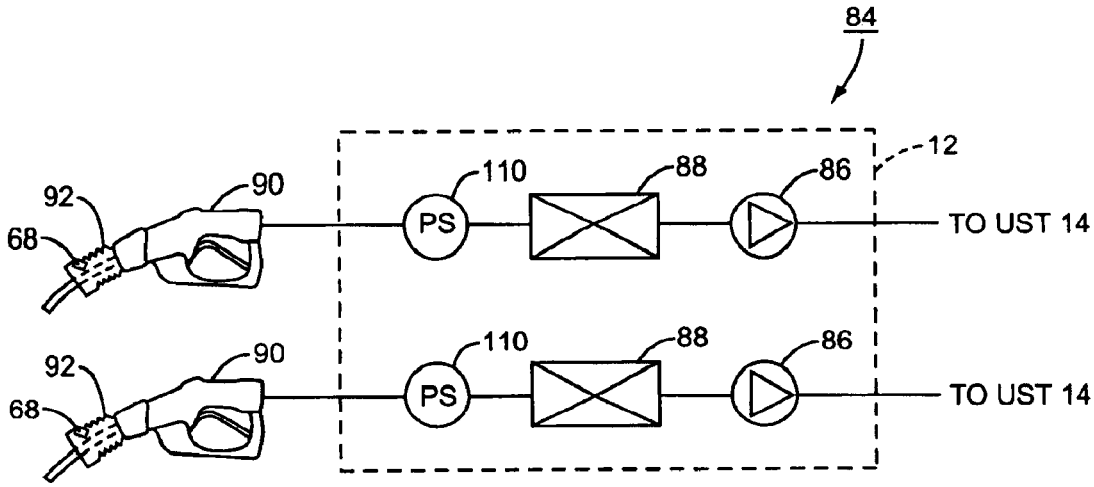
FIG. 8 illustrates schematically the system of FIG. 5 with a pressure sensor.
Figure 9:
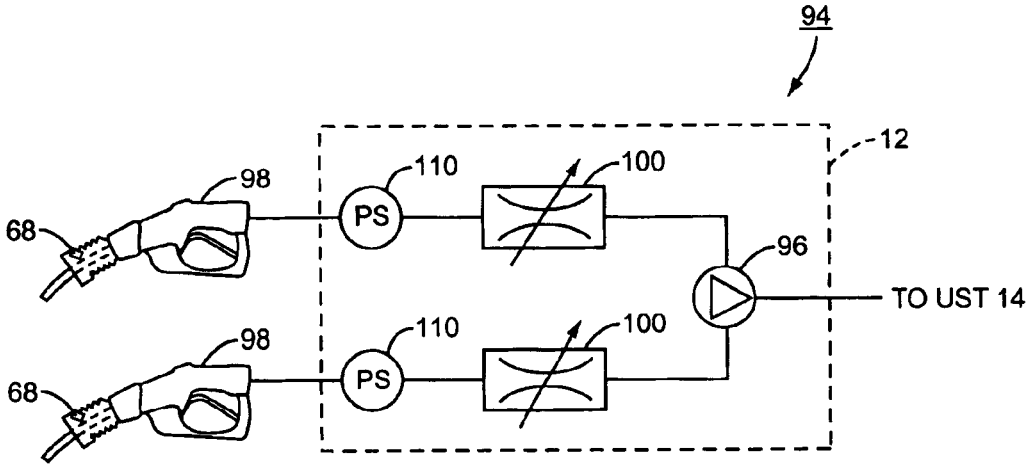
FIG. 9 illustrates schematically the system of FIG. 6 with a pressure sensor configured as an alternative embodiment.
Figure 10:
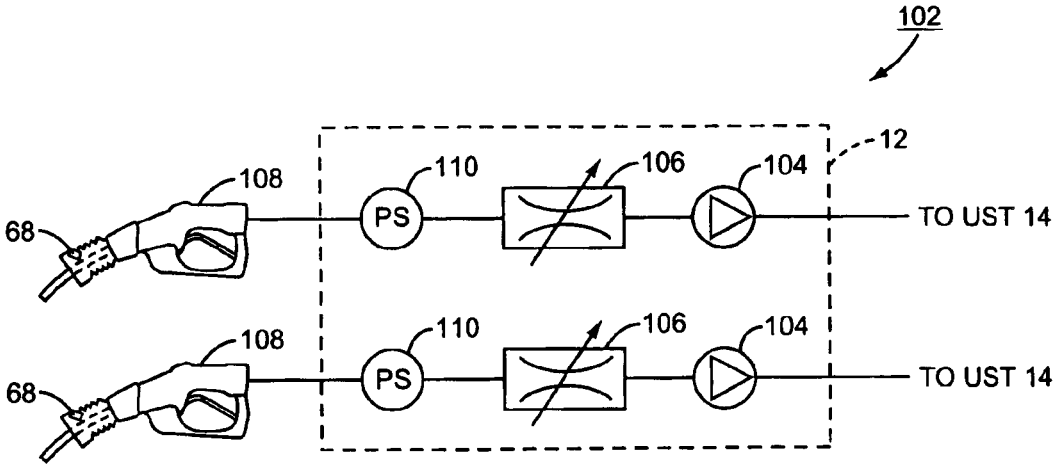
FIG. 10 illustrates schematically the system of FIG. 7 with a pressure sensor configured as an alternative embodiment.

Specifically, FIGS. 8–10 are closely analogous to FIGS. 5–7, respectively, albeit with a pressure sensor (PS) 110 associated with the vapor return line, and positioned upstream of the corresponding valves 88, 100, and 106. In operation, the pressure sensors 110 will detect a pressure difference, namely that the ORVR vehicle 54 is lower than a standard non-ORVR vehicle, and report this to the fuel dispenser controller 48 (FIG. 1). The fuel dispenser controller 48 can determine from the pressure reading whether or not an ORVR vehicle is being fueled.

Figure 11:
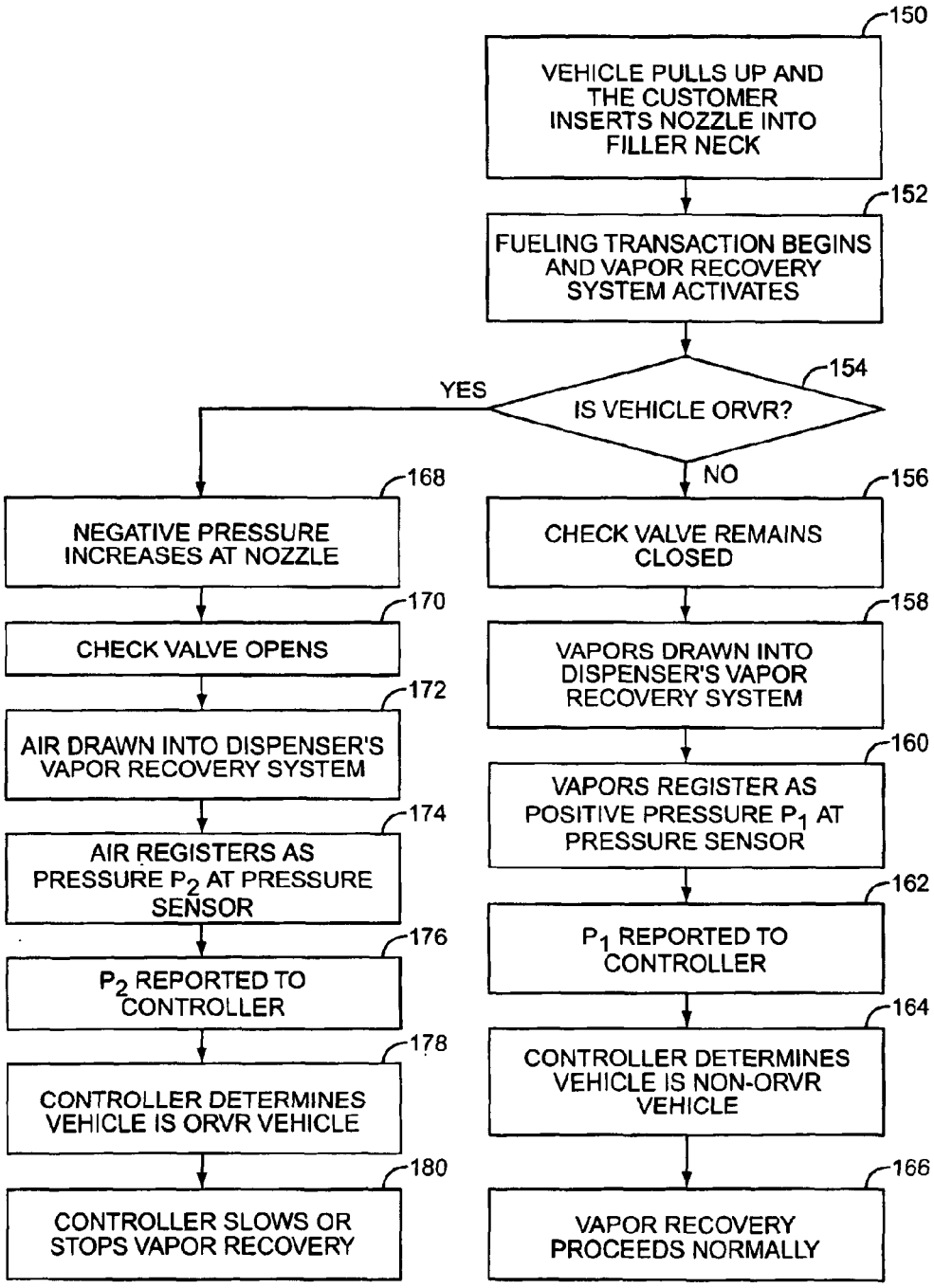

A flow chart of the present invention operating with the pressure sensor 110 is illustrated in FIG. 11. The process begins when the vehicle 54 pulls into the fueling environment 10 and inserts the nozzle into the filler neck 52 (block 150). The customer then interacts with the customer interface 50 to authorize the fueling transaction, the fueling transaction begins, and the vapor recovery system activates (block 152). Note that the interaction may be through an attendant, an attendant may insert the nozzle, the nozzle may be inserted part way through the interaction with the customer interface 50, or other variations as are well understood in the fueling industry.

The process branches at block 154 depending on whether the vehicle 54 is an ORVR vehicle. Note that block 154 is not a determination as to whether the vehicle 54 is ORVR equipped, but rather the mechanical events vary based on whether the vehicle 54 is ORVR equipped or not. If the answer to block 154 is no, the vehicle 54 is not an ORVR vehicle, then the pressure levels at the check valve 68 allow the check valve 68 to remain closed (block 156). Vapors are drawn into the fuel dispenser's vapor recovery system (block 158). These vapors register as a comparatively high pressure $P_1$ at the pressure sensor 110 (block 160). $P_1$ is reported by the pressure sensor 110 to the fuel dispenser controller 48 (block 162). The fuel dispenser controller 48 determines, based on $P_1$, that the vehicle 54 is a non-ORVR vehicle (block 164) and the vapor recovery process proceeds normally (block 166). Note that the determination may be done by comparing $P_1$ to a threshold, and if $P_1$ is greater than the threshold (even if the threshold is a negative pressure), then the controller 48 may decide that the vehicle is a non-ORVR vehicle.

If however, the answer to block 154 is yes, the vehicle 54 is an ORVR vehicle, then negative pressure increases at the nozzle (block 168) (that is, the pressure level decreases to a point lower than would be present with a standard non-ORVR vehicle). This pressure level causes the check valve 68 to open (block 170). Air is then drawn in through the check valve 68 into the vapor recovery system (block 172). The air passes to the nozzle to alleviate the negative pressure, and also registers as pressure $P_2$ at the pressure sensor 110 (block 174). $P_2$ is reported to the fuel dispenser controller 48 (block 176). Based on empirical testing done to date, there is a measurable difference between $P_2$ and $P_1$. This difference can loosely be quantified as $P_2<P_1$. Based on some threshold criteria that reflects the difference in $P_1$ and $P_2$, the fuel dispenser controller 48 determines that the vehicle 54 is an ORVR vehicle (block 178). The fuel dispenser controller 48 then slows or stops vapor recovery (block 180).

The fuel dispenser-controller 48 may slow the vapor recovery by slowing a variable speed pump 86 or by adjusting the degree to which the proportional valves 100, 106 are opened. The fuel dispenser controller 48 may stop the vapor recovery by turning the pumps 86, 96 or 104 off or by closing the valves 88, 100 or 106. By slowing or stopping the vapor recovery, the process helps prevent over-pressurization of the underground storage tank 14.

The report from the pressure sensor 110 to the fuel dispenser controller 48 may also occur at different times. In a first embodiment, the pressure sensor 110 may report to the fuel dispenser controller 48 within five seconds of the fueling transaction beginning. In a second embodiment, the pressure sensor 110 may report to the fuel dispenser controller 48 after five seconds but before the end of the fueling transaction. A specifically contemplated embodiment has the pressure sensor 110 report to the fuel dispenser controller 48 approximately thirty seconds after the fueling transaction begins.

Figure 12:
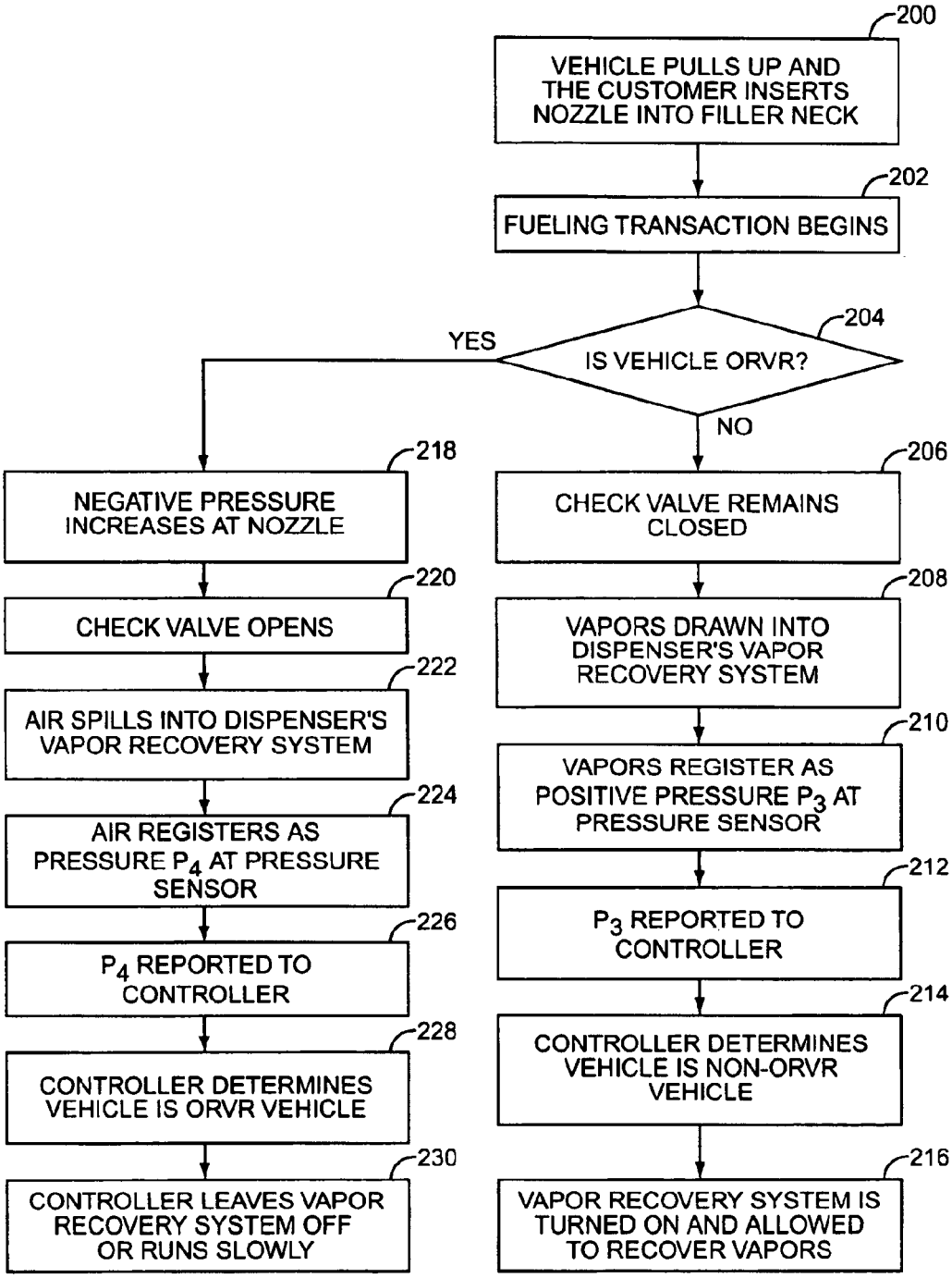
FIG. 12 illustrates a flow chart showing a second embodiment of the process of the present invention wherein the vapor recovery system is normally off.

The embodiment of FIG. 11 contemplates that the vapor recovery system starts vapor recovery operations as soon as the fueling transaction begins. Still another embodiment contemplates that the vapor recovery system does not start immediately after the fueling transaction begins. This embodiment is illustrated in FIG. 12.

The process begins when the vehicle 54 pulls into the fueling environment 10 and the customer inserts the nozzle into the filler neck 52 (block 200). The fueling transaction then begins (block 202). At this time, the vapor recovery system is off. Note that as discussed above, the precise order of transactional processing and insertion details may be varied without departing from the scope of the present invention. Again, the process splits depending on if the vehicle 54 is an ORVR vehicle or not (block 204).

If the answer to block 204 is no, the vehicle 54 is not an ORVR vehicle, then the check valve 68 remains closed (block 206). Vapors are pushed into the dispenser's vapor recovery system by virtue of the incoming fuel displacing the vapors from the fuel tank 56 and the boot capturing the vapors (much like a traditional balance system at this point) (block 208). The vapors will register as a positive pressure $P_3$ at the pressure sensor 110 (block 210). Note that in the case where the vacuum assist is off, the pressure $P_3$ is likely to be positive, although there are instances where it could conceivably be negative, but not to a great degree. $P_3$ is reported to the fuel dispenser controller 48 (block 212). The fuel dispenser controller 48 then determines, based on the reported pressure value from the pressure sensor 110, that the vehicle 54 is a non-ORVR vehicle (block 214). Based on the determination that the vehicle 54 is a non-ORVR vehicle, the vapor recovery system is turned on and allowed to operate normally (block 216).

If, however, the answer to block 204 is yes, the vehicle is an ORVR vehicle, then the ORVR system of the vehicle 54 creates a negative pressure at the nozzle (block 218) or at least a pressure which is comparatively lower than $P_3$. This negative pressure causes the check valve 68 to open (block 220). Air is drawn into the ORVR system through the check valve 68 and some spills over into the dispenser's vapor recovery system (block 222). This air that has spilled into the dispenser's vapor recovery system registers as a pressure $P_4$ at the pressure sensor 110 (block 224). $P_4$ is reported to the fuel dispenser controller 48 (block 226). The fuel dispenser controller 48 determines, based on the reading from the pressure sensor 110, that the vehicle 54 is an ORVR vehicle (block 228). The fuel dispenser controller 48 then leaves the vapor recovery system turned off or, if appropriate, runs the vapor recovery system at a slow rate to recover some air to replace fuel removed from the underground storage tank 14 (block 230).

Note that $P_4$ has been determined to be high enough to be measurable and distinct enough that it can be differentiated from $P_1$, $P_2$, and $P_3$. Based on some threshold, the fuel dispenser controller 48 can decide whether the vehicle 54 is an ORVR vehicle or not. Again, like the previous embodiment, the measuring and reporting by the pressure sensor 110 can occur at various locations during the fueling transaction, such as the beginning or some time into the fueling transaction.

In the initial tests of the present invention the following ranges were noted for the pressure readings. Note that these pressure readings do change as a function of placement of the pressure sensor 110, whether the vacuum pump is on or off, the presence of an ORVR vehicle or a standard vehicle and other parameters. However, in the interests of full disclosure, the following value ranges were noted.

In a situation where the vacuum pump was off, and a vapor valve was open, $P_3$ varied between approximately 0.5 inches water column and 8.5 inches water column if measured in the filler neck 54 of the vehicle. $P_3$ varied between 0.5 inches water column and 2 inches water column if measured within the dispenser. $P_4$ varied between 0 inches water column and −1 inches water column in both measuring locations. Thus, it is clear to see that there is a demonstrable difference between $P_3$ and $P_4$.

In a situation where the vacuum pump was off, and a vapor valve was closed, $P_3$ varied between approximately 0.5 inches water column and 12 inches water column if measured in the filler neck 54 or within the dispenser. $P_4$ varied between 0 inches water column and −1 inches water column in both measuring locations. Thus, it is clear to see that there is a demonstrable difference between $P_3$ and $P_4$.

In a situation where the vacuum pump was on, $P_1$ varied between approximately 0 inches water column and 4 inches water column if measured in the filler neck 54 of the vehicle. $P_1$ varied between −10 inches water column and −7 inches water column if measured within the dispenser. $P_2$ varied between −2 inches water column and −4 inches water column if measured in the filler neck 54 and between −11 and −8 inches water column if measured in the dispenser. Thus, it is clear to see that there is a demonstrable difference between $P_1$ and $P_2$. To this extent, the appropriate thresholds can be chosen and programmed into the dispenser controller 48 and the appropriate decisions made in the processes of FIGS. 11 and 12.

Thus, the present invention allows the fuel dispenser controller 48 to determine if the vehicle 54 is an ORVR vehicle and control the vapor recovery system appropriately. Even if the pressure sensor 110 is not used, the present invention's use of a check valve 68 still helps prevent nuisance shut-offs at the nozzle and thus promotes proper fuel dispensing.

Those skilled in the art will recognize improvements and modifications to the preferred embodiments of the present invention. All such improvements and modifications are considered within the scope of the concepts disclosed herein and the claims that follow.

What is claimed is:

1. A fuel dispenser comprising:

a vapor recovery system, comprising:

a hose;

a nozzle comprising a boot, said nozzle connected to said hose;

a check valve adapted to let air into said vapor recovery system selectively if a negative pressure is exerted on said nozzle;

a controller adapted to control functions of the fuel dispenser including the vapor recovery system; and a pressure sensor, said pressure sensor associated with said vapor recovery system and reporting pressure readings to said controller.

2. The fuel dispenser of claim 1 wherein said vapor recovery system is a balance vapor recovery system.

3. The fuel dispenser of claim 1 wherein said vapor recovery system further comprises a pump to draw vapors into said vapor recovery system.

4. The fuel dispenser of claim 3 wherein said pump is a constant speed pump.

5. The fuel dispenser of claim 3 wherein said pump is a variable speed pump.

6. The fuel dispenser of claim 1 wherein said boot is a mini-boot.

7. The fuel dispenser of claim 1 wherein said boot is a full-sized boot.

8. The fuel dispenser of claim 1 wherein said check valve is positioned in said boot.

9. The fuel dispenser of claim 1 wherein said check valve is positioned in said hose.

10. The fuel dispenser of claim 1 wherein said check valve is positioned in said nozzle.

11. The fuel dispenser of claim 1 wherein said controller is adapted to determine if a vehicle being fueled is equipped with an onboard vapor recovery system based on pressure readings from said pressure sensor.

12. The fuel dispenser of claim 11 wherein said controller is adapted to turn off said vapor recovery system if the vehicle is equipped with an onboard vapor recovery system.

13. The fuel dispenser of claim 11 wherein said controller is adapted to turn on said vapor recovery system if the vehicle is not equipped with an onboard vapor recovery system.

14. The fuel dispenser of claim 1 wherein said pressure readings are provided at a time corresponding to a beginning of a fueling transaction.

15. The fuel dispenser of claim 1 wherein said pressure readings are provided at a time after commencement of a fueling transaction.

16. The fuel dispenser of claim 1 wherein said check valve allows air to pass into said boot when said check valve is open.

17. The fuel dispenser of claim 16 wherein said air offsets the negative pressure and prevents a nuisance shut-off during fueling transaction.

18. The fuel dispenser of claim 8 wherein said vapor recovery system is a balance vapor recovery system.

19. The fuel dispenser of claim 8 wherein said vapor recovery system further comprises a pump to draw vapors into said vapor recovery system.

20. The fuel dispenser of claim 19 wherein said pump is a pump comprised from the group consisting of a constant speed pump and a variable speed pump.

21. The fuel dispenser of claim 8 wherein said boot is a boot comprised from the group consisting of a mini-boot and a full-sized boot.

22. The fuel dispenser of claim 8 wherein said controller is adapted to determine if a vehicle being fueled is equipped with an onboard vapor recovery system based on pressure readings from said pressure sensor.

23. The fuel dispenser of claim 22 wherein said controller is adapted to turn off said vapor recovery system if the vehicle is equipped with an onboard vapor recovery system.

24. The fuel dispenser of claim 22 wherein said controller is adapted to turn on said vapor recovery system if the vehicle is not equipped with an onboard vapor recovery system.

25. The fuel dispenser of claim 8 wherein said pressure readings are provided at a time corresponding to a beginning of a fueling transaction.

26. The fuel dispenser of claim 8 wherein said pressure readings are provided at a time after commencement of a fueling transaction.

27. The fuel dispenser of claim 8 wherein said check valve allows air to pass into said boot when said check valve is open.

28. The fuel dispenser of claim 27 wherein said air offsets the negative pressure and prevents a nuisance shut-off during a fueling transaction.

29. The fuel dispenser of claim 9 wherein said vapor recovery system is a balance vapor recovery system.

30. The fuel dispenser of claim 9 wherein said vapor recovery system further comprises a pump to draw vapors into said vapor recovery system.

31. The fuel dispenser of claim 30 wherein said pump is a pump comprised from the group consisting of a constant speed pump and a variable speed pump.

32. The fuel dispenser of claim 9 wherein said boot is a boot comprised from the group consisting of a mini-boot and a full-sized boot.

33. The fuel dispenser of claim 9 wherein said controller is adapted to determine if a vehicle being fueled is equipped with an onboard vapor recovery system based on pressure readings from said pressure sensor.

34. The fuel dispenser of claim 33 herein said controller is adapted to turn off said vapor recovery system if the vehicle is equipped with an onboard vapor recovery system.

35. The fuel dispenser of claim 33 wherein said controller is adapted to turn on said vapor recovery system if the vehicle is not equipped with an onboard vapor recovery system.

36. The fuel dispenser of claim 9 wherein said pressure readings are provided at a time corresponding to a beginning of a fueling transaction.

37. The fuel dispenser of claim 9 wherein said pressure readings are provided at a time after commencement of a fueling transaction.

38. The fuel dispenser of claim 9 wherein said check valve allows air to pass into said boot when said check valve is open.

39. The fuel dispenser of claim 38 wherein said air offsets the negative pressure and prevents a nuisance shut-off during a fueling transaction.

40. The fuel dispenser of claim 10 wherein said vapor recovery system is a balance vapor recovery system.

41. The fuel dispenser of claim 10 wherein said vapor recovery system further comprises a pump to draw vapors into said vapor recovery system.

42. The fuel dispenser of claim 41 wherein said pump is a pump comprised from the group consisting of a constant speed pump and a variable speed pump.

43. The fuel dispenser of claim 10 wherein said boot is a boot comprised from the group consisting of a mini-boot and a full-sized boot.

44. The fuel dispenser of claim 10 wherein said controlled is adapted to determine if a vehicle being fueled is equipped with an onboard vapor recovery system based on pressure readings from said pressure sensor.

45. The fuel dispenser of claim 44 wherein said controller is adapted to turn off said vapor recovery system if the vehicle is equipped with an onboard vapor recovery system.

46. The fuel dispenser of claim 44 wherein said controller is adapted to turn on said vapor recovery system if the vehicle is not equipped with an onboard vapor recovery system.

47. The fuel dispenser of claim 10 wherein said pressure readings are provided at a time corresponding to a beginning of a fueling transaction.

48. The fuel dispenser of claim 10 wherein said pressure readings are provided at a time after commencement of a fueling transaction.

49. The fuel dispenser of claim 10 wherein said check valve allows air to pass into said boot when said check valve is open.

50. The fuel dispenser of claim 49 wherein said air offsets the negative pressure and prevents a nuisance shut-off during a fueling transaction.

* * * * *